US006796161B2

(12) United States Patent
Hsieh

(10) Patent No.: US 6,796,161 B2
(45) Date of Patent: Sep. 28, 2004

(54) FASTENING DEVICE OF A PUNCH ASSEMBLY FOR A PNEUMATIC TOOL

(76) Inventor: Yu-Fu Hsieh, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 10/330,803

(22) Filed: Dec. 24, 2002

(65) Prior Publication Data

US 2004/0118177 A1 Jun. 24, 2004

(51) Int. Cl.[7] ..... B21J 9/18
(52) U.S. Cl. ..... 72/453.16; 72/416; 30/360
(58) Field of Search ..... 72/453.16, 416; 30/358, 360, 361, 362

(56) References Cited

U.S. PATENT DOCUMENTS 2,696,850 A * 12/1954 Peterson ..... 72/416
2,729,063 A * 1/1956 Hoadley ..... 72/453.16
3,017,905 A * 1/1962 Klein ..... 72/453.16
3,972,218 A * 8/1976 Pawloski ..... 72/453.16
5,839,316 A * 11/1998 Kolivoski et al. ..... 72/453.16
6,457,243 B2 * 10/2002 Kimura ..... 30/360

* cited by examiner

*Primary Examiner*—David Jones
(74) *Attorney, Agent, or Firm*—Troxell Law Office PLLC

(57) ABSTRACT

A fastening device of a punch assembly of a metal-work pneumatic tool including a threaded rod on a front end of a body of the pneumatic metal-work tool, and the threaded rod is connected, by means of threads, with a punch assembly. The punch assembly has a threaded rod with threads for mounting a threaded ring and a fastening ring mounted around the threaded ring. The position of the threaded ring is to be varied with the setting position of the punch assembly after proper adjustment. The threaded ring will be fastened in place with a stop screw so as to facilitate the later replacement of another punch assembly in a pre-set position without further adjustment of distance.

3 Claims, 6 Drawing Sheets

FASTENING DEVICE OF A PUNCH ASSEMBLY FOR A PNEUMATIC TOOL

BACKGROUND OF THE INVENTION

1. Field of the Invention

This invention relates to a metal-work tool, particularly to a fastening device for a pneumatic punch assembly which can provide a punch operation or an edge-folding operation.

2. Description of the Prior Art

In a conventional pneumatic metal-work tool, the casing thereof has a position with a piston rod in the center thereof; one end of the piston rod extends into a hydraulic chamber, in which a push rod is furnished, and extends out; the end of the push rod is connected with a punch assembly. As soon as a pressure air is filled into the casing, the pressure air will push the piston to move, and simultaneously the piston rod in the hydraulic chamber will provide a pressure therein to cause a push rod to move and also to have the punch assembly to actuate for punch operation on a metal sheet. The hydraulic chamber on the front end of the casing is used for converting air power into a hydraulic power so as to obtain a higher punch force; however, a hydraulic leak could take place between the hydraulic chamber and the cylinder chamber after long time operation; in that case, the hydraulic push power would be reduced, and the oil in the hydraulic chamber must be replenished properly.

In a patent application Ser. No. 10/157,856, "Pneumatic Metal-work Tool" of the applicant, a punch assembly is mounted on the front end of a hydraulic push-rod assembly; the hydraulic chamber of the hydraulic push-rod assembly is mounted with a piston rod, of which one end is mounted in a center hole of a piston in a cylinder. After a high pressure air is filled into the casing by means of a control-valve assembly, the pressure air will push the piston rod to move so as to have the pressure air converted into a hydraulic power by means of the hydraulic chamber, and then the hydraulic push rod will provide a punch force, and to cause the punch assembly to punch a hole or holes in a metal sheet; however, when a punch assembly having different size is changed, the punch distance has to be adjusted properly; therefore, it is deemed an inconvenient defect.

SUMMARY OF THE INVENTION

The prime object of the present invention is to provide a pneumatic metal-work tool, in which the punch assembly on the front end of the body can be replaced with different size without readjusting the punch distance by means of a threaded ring mounted on the threads of the body in the punch assembly.

Another object of the present invention is to provide a pneumatic metal-work tool, in which the threaded ring on the threads of the body of the punch assembly is furnished with threads on the inner curved surface thereof so as to facilitate the threaded ring to move along the threads of the cylindrical body of the punch assembly; the center curved surface of the threaded ring is furnished with a screw hole for receiving a stop screw; after the stop screw is set loose, the fastening ring around the threaded ring will be loosened; then, the threaded ring can be moved along the threads of the body of the punch assembly to adjust its position freely; finally, the threaded ring can be fastened to the body of the punch assembly with the stop screw so as to limit a given distance between the fastening ring and the threaded rod of the body of the pneumatic metal-work tool.

Still another object of the present invention is to provide a pneumatic metal-work tool, in which the threaded ring on the threads of the body of the punch assembly is mounted with a fastening ring; the inner curved surface of the fastening ring is furnished with threads and a cylindrical surface, which is used for receiving the threaded ring, and the inner side thereof has a shoulder portion to be in contact with the cylindrical surface of the threaded ring; the outer surface of the fastened ring is furnished with vertical threads and a through rectangular hole; the rectangular hole facilitates a hexagonal wrench to extend through so as to drive the stop screw on the threaded ring until the stop screw being fastened to the threads of the threaded rod and to limit the threaded ring to move; after the stop screw is set loose, the position of the threaded ring can be adjusted properly.

A further object of the present invention is to provide a pneumatic metal-work tool, in which the threaded ring and the fastening ring mounted on the threads of the cylindrical body of the punch assembly can be fastened to a different punch assembly directly for punch operation without adjusting the fastening distance upon changing a punch assembly having different size.

DETAILED DESCRIPTION OF THE PREFERRED EMBODIMENT

Figure 1:
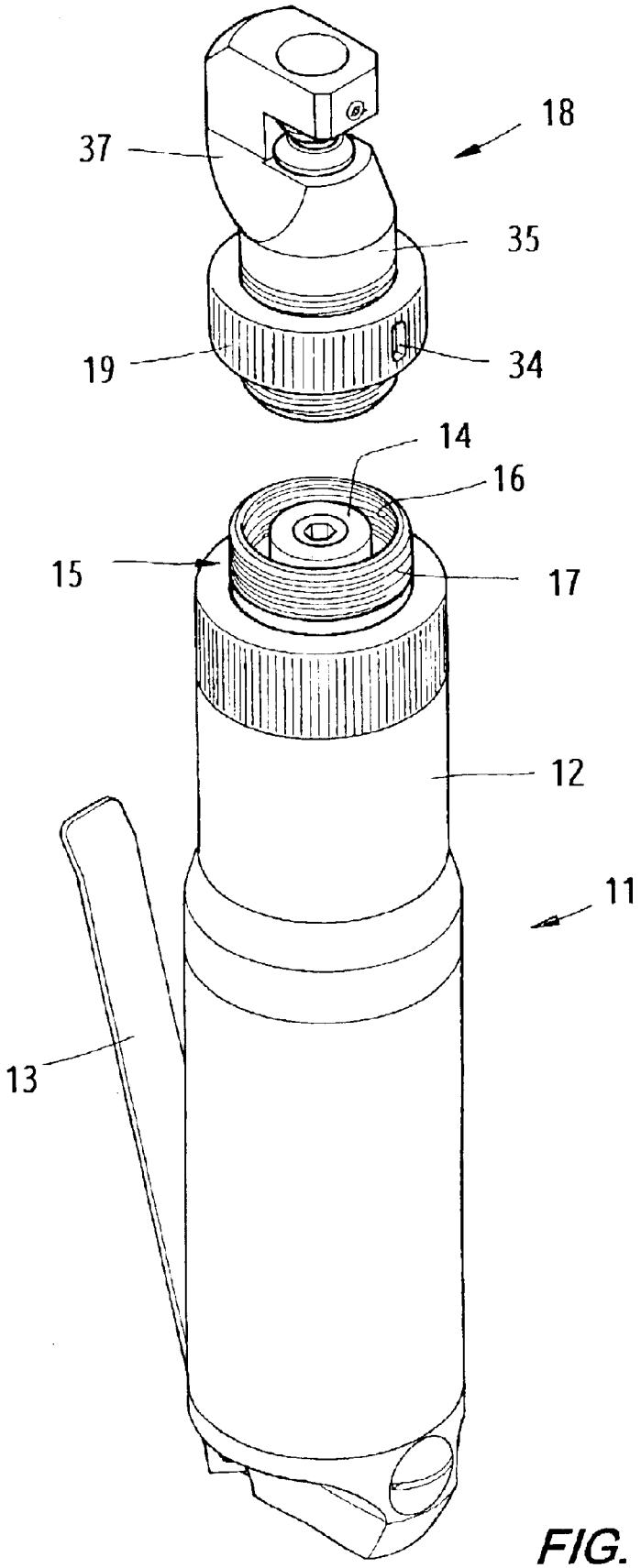
FIG. 1 is a disassembled view of the present invention, showing the body separated from the punch assembly.
Figure 2:
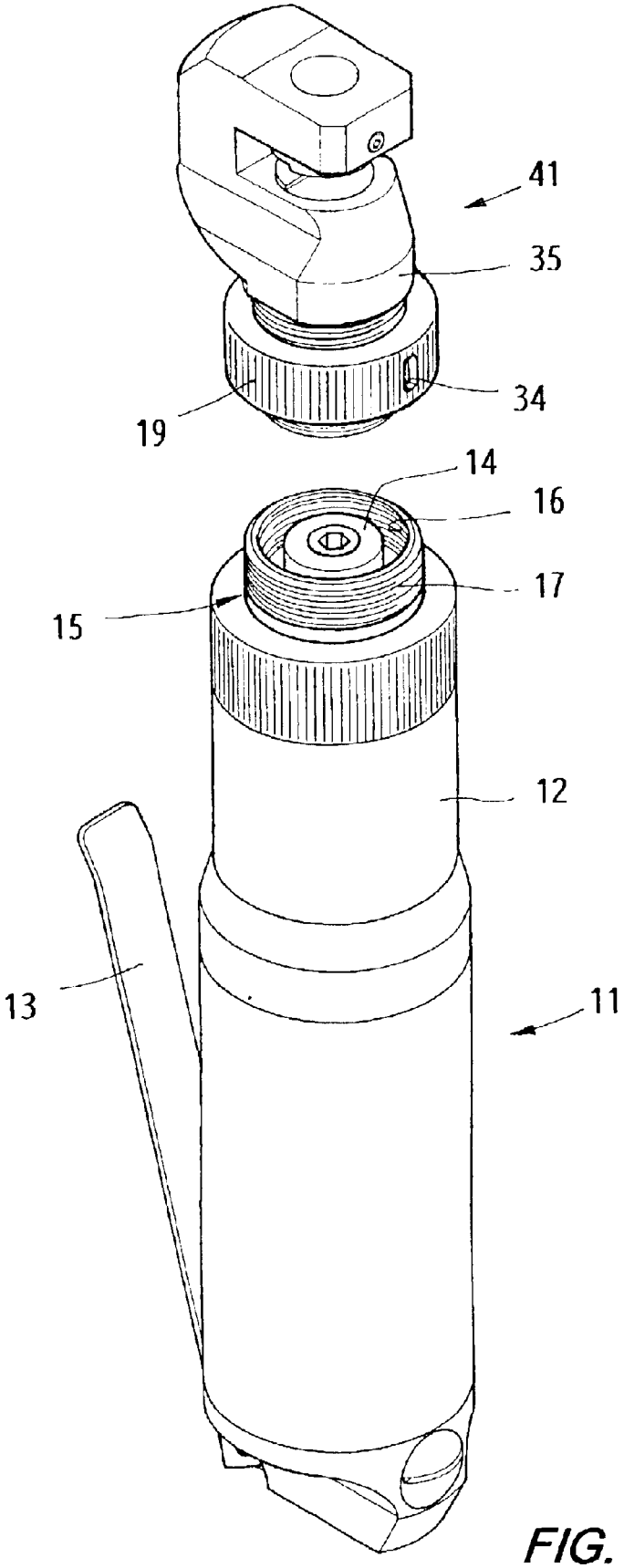
FIG. 2 is a disassembled view of the present invention, showing he body separated from the edge-folding assembly.

This invention relates to an adjustment and positioning device of a punch assembly of a pneumatic metal-work tool; as shown in FIGS. 1 to 2, the front end of the body 12 of the pneumatic metal-work tool is furnished with a threaded rod 15; the mid-part thereof is furnished with a punch shaft 14; the inner surface and the outer surface of the threaded rod 15 are furnished with threads 16 and 17 respectively; the inner threads are used for mounting a cylindrical body 35 of an actuation assembly (such as a punch assembly 18 or an edge-folding assembly 41); by means of a fastening ring 19, the cylindrical body 35 can be fastened to the threaded rod 15 of the body 12 so as to have the guide shaft 40 of the punch shaft 14 and the guide shaft 40 of an actuation assembly (a punch assembly 18 or an edge-folding assembly 41) connected together for punching operation or edge-folding operation.

Figure 3:
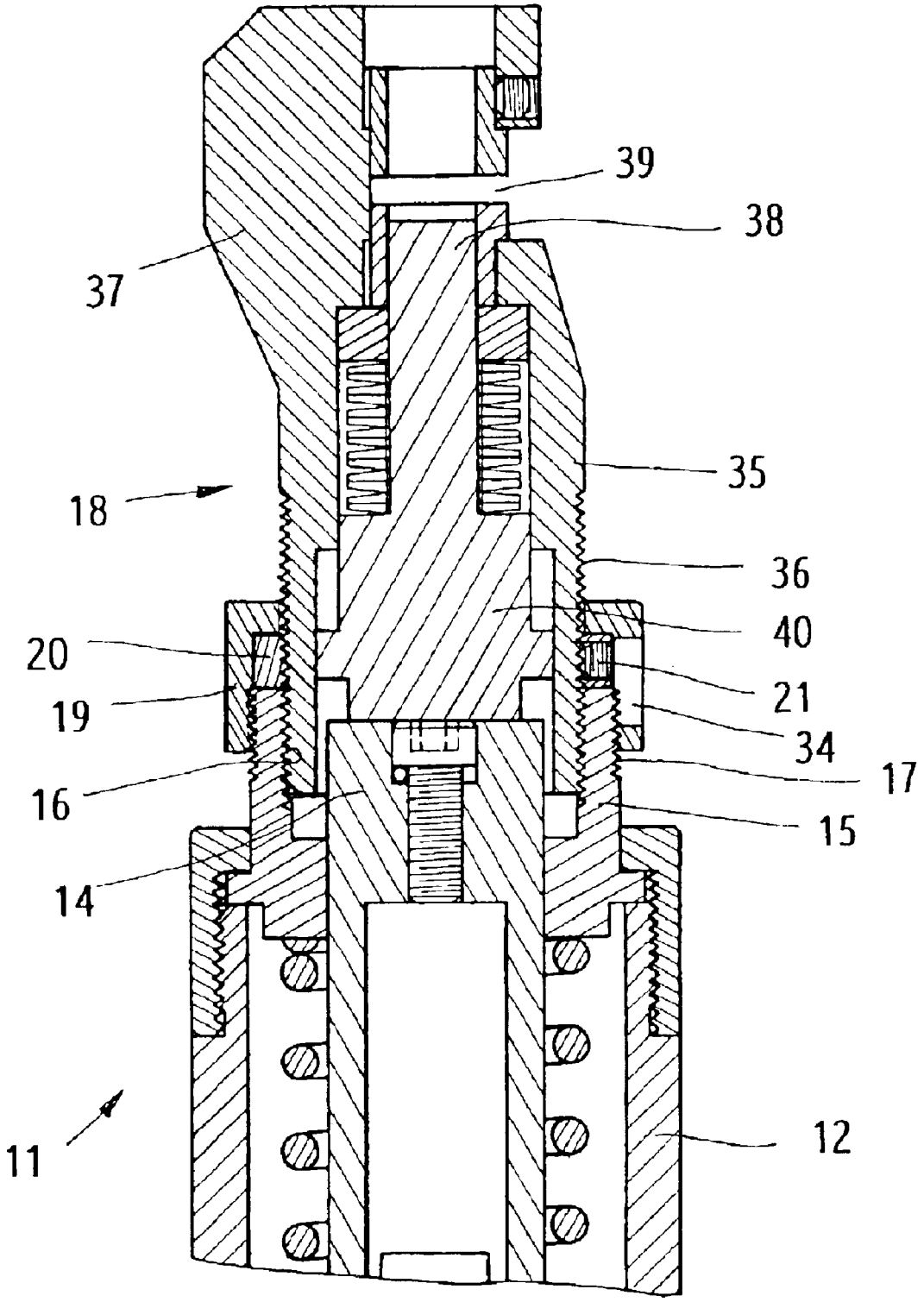
FIG. 3 is a disassembled view of the present invention, showing the punch assembly being disassembled.
Figure 4:
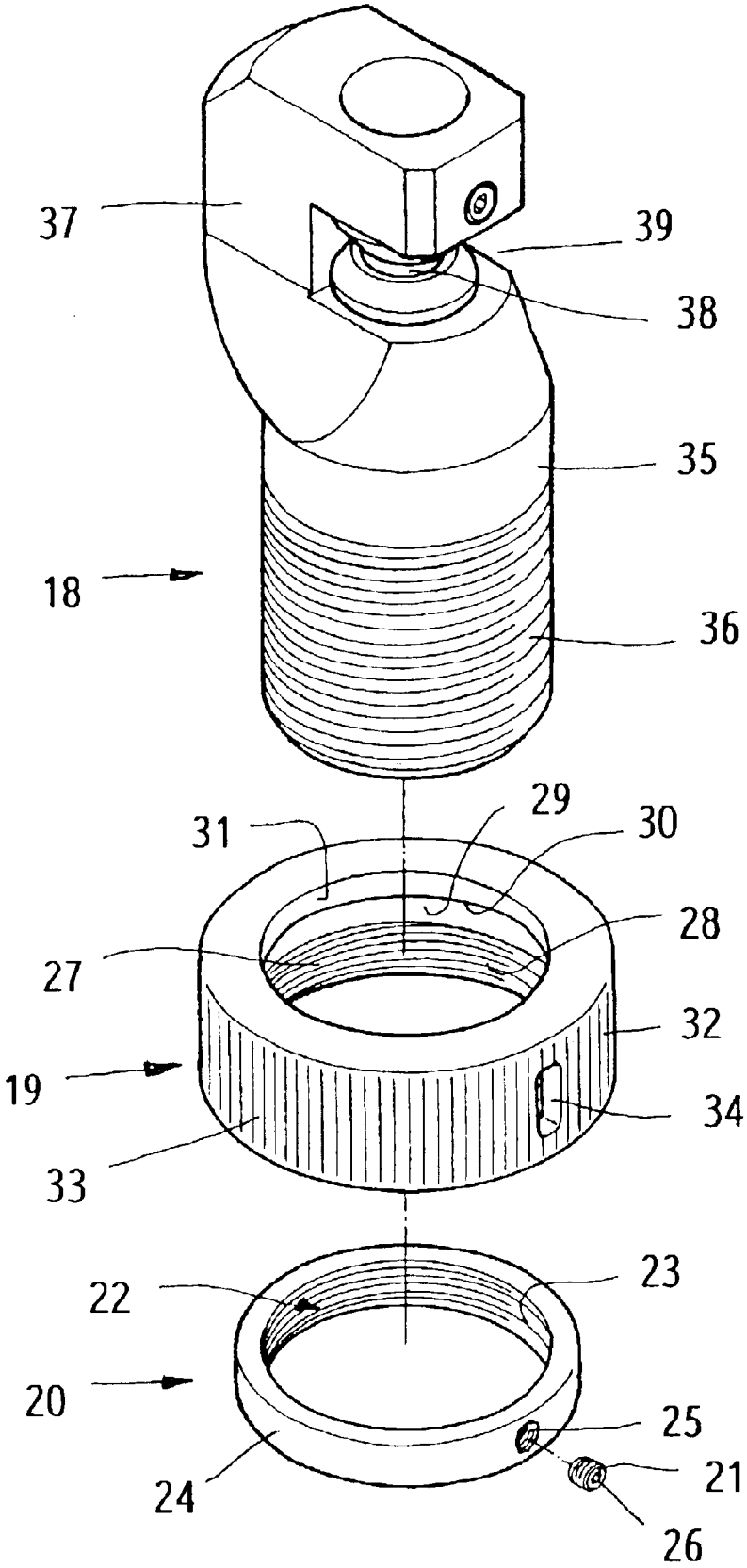
FIG. 4 is a sectional view of the present invention, showing the structure of the punch assembly.
Figure 5:
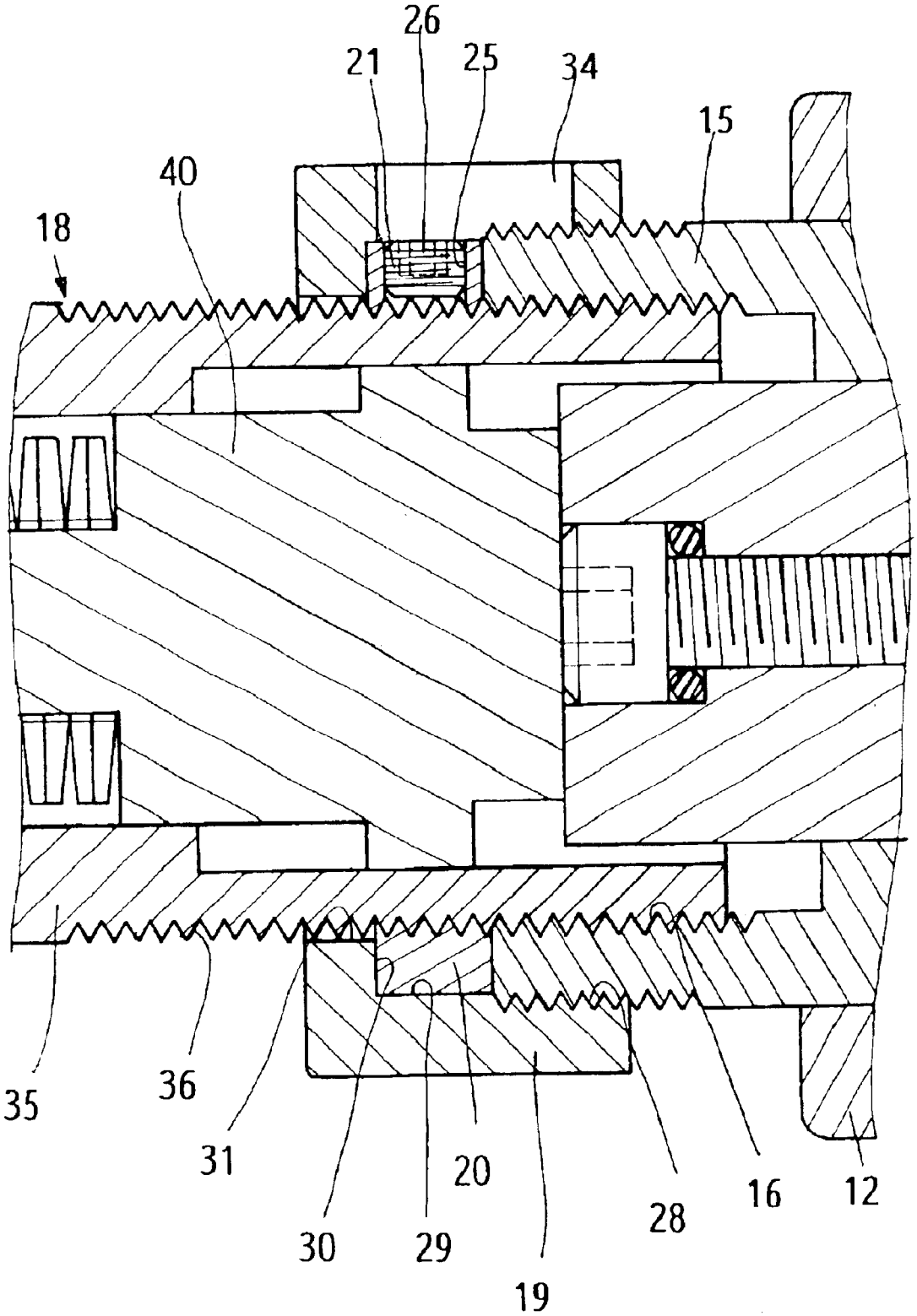
FIG. 5 is a sectional view of the present invention, showing an enlarged view of the punch assembly.
Figure 6:
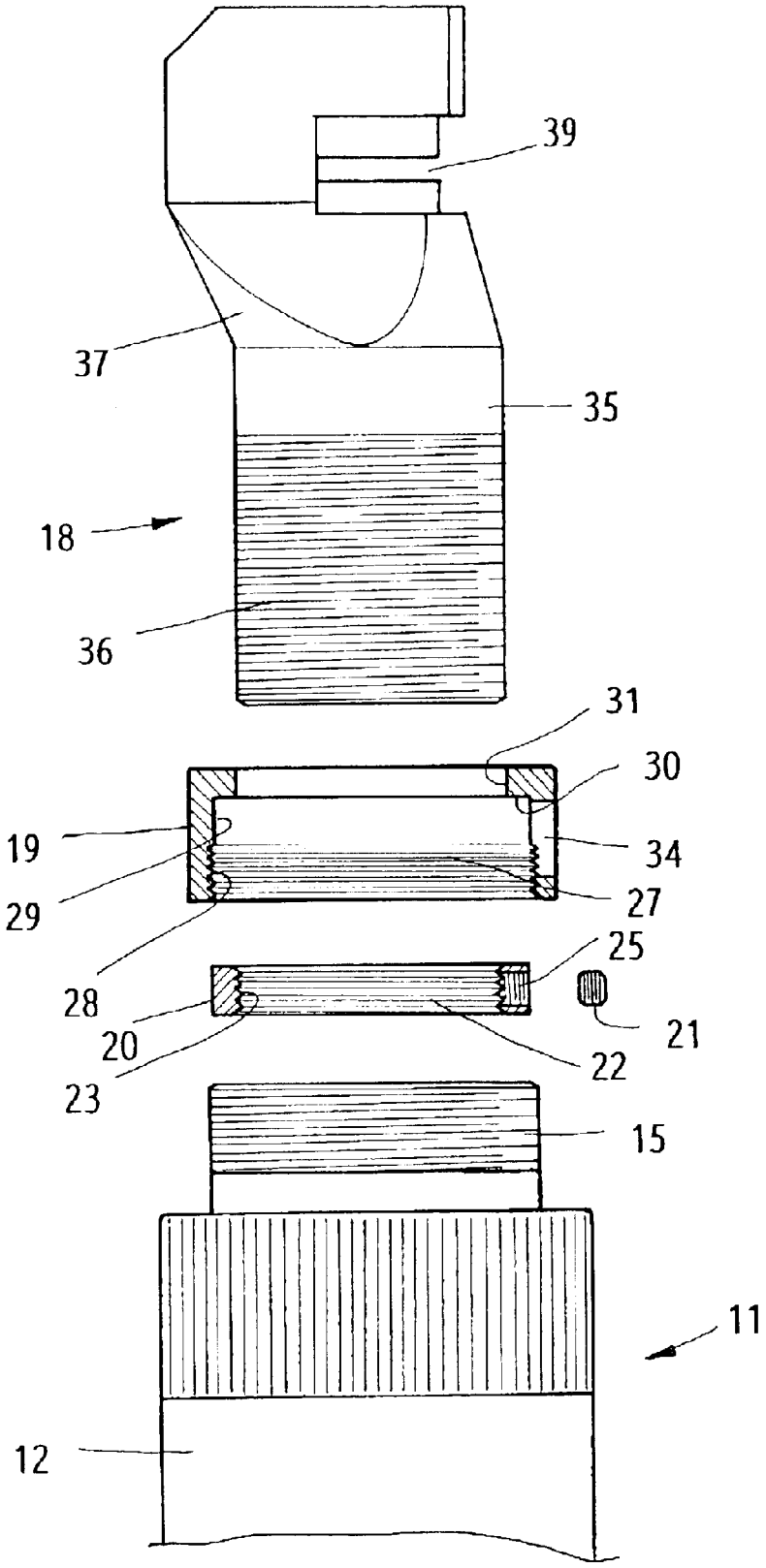
FIG. 6 is a plan view of the present invention, showing the punch assembly being disassembled.

Referring to FIGS. 1, 3, to 6, the threaded rod 15 on the front end of the pneumatic metal-work tool 11 is connected with the punch assembly 18, of which the outer end is furnished with a C-shaped base 37 and a cylindrical body 35; the cylindrical body 35 is furnished with threads 36 to be engaged with a fastening ring 19 and a threaded ring 20. The inside of the cylindrical body 35 is mounted with a punch shaft 38 and a punch assembly 40. One side of the C-shaped base 37 of the punch assembly 18 has a guide opening 39 for receiving a metal sheet. The power provided by the body 12 of the pneumatic metal-work tool 11 is to be transmitted to a punch shaft 38 in the punch assembly 18 via the punch shaft 14 so as to punch a hole or holes in a metal sheet.

The metal work of a car usually includes two operations, i.e., the edge-folding operation and the punch working. The hole-punching work includes three different holes in terms of diameter thereof. In order to facilitate the replacement of the punch assembly 18 or the edge-folding assembly on the front end of the pneumatic metal-work tool 11, the connection and distance between the punch assembly 18 and the punch shaft 14 of the body 12 have been designed and adjusted properly without affecting the power transmission. In order to facilitate the fastening and positioning between the punch assembly 18 and the threaded rod 15 on the body 12, the threads 36 of the cylindrical body 35 in the punch assembly 18 is furnished with a fastening device, which includes a fastening ring 19, a threaded ring 20, and a threaded rod 15 on the front end of the body 12; the threaded ring 20 is to be mounted on the threads 36 of the cylindrical body 35 in the punch assembly 18; a stop screw 21 is to be mounted in a screw hole 25 on one side of the threaded ring 20; the fastening ring 19 is mounted around the threaded ring 20. The threads 36 of the cylindrical rod 35 are designed to fit to the threads 16 of the threaded rod 15 on the front end of the body 12. The threads 36 of the cylindrical body 35 in the punch assembly 18 is to be mounted in a threaded hole 16 of the threaded rod 15 on the front end of the body 12; the distance between the threads 36 of the punch assembly 18 and the threaded hole 16 of the body 12 is pre-set by means of a threaded ring 20; a fastening ring 19 on the threaded ring 20 is mounted to the threads 17 of the threaded rod 15 so as to have the punch assembly 18 and the threaded rod 15 on the front end of the body 12 connected together quickly; then, when the punch shaft 14 is operated, the punch shaft 38 in the punch assembly 18 will punch or do edging operation at a pre-set length; the punch assembly 18 can be mounted in place or replaced swiftly.

The threaded ring 20 of the fastening device is substantially a ring-shaped member with a rectangular section, of which the inner surface 22 is furnished with threads 23, while the outer curved surface 24 thereof is a smooth surface. One side of the threaded ring 20 is furnished with a through screw hole 25 for receiving a stop screw 21; the inner surface of the threaded ring 20 is furnished with threads 23 to be engaged with the threads 36 of the cylindrical body 35 in the punch assembly 18. The threaded ring 20 can be moved upwards along the cylindrical body 35 for adjusting he position thereof. The screw hole 25 furnished in the threaded ring 20 is used for receiving a stop screw 21, which has a hexagonal hole 26 on one end thereof for receiving a hexagonal wrench so as to set the stop screw 21 tightly in place. As soon as the threaded ring 20 is set at a preferred position along the threads 36 of the cylindrical body 35, it will be fixed in place with the stop screw 21 without moving or loosening unintentionally.

The fastening ring 19 of the fastening device includes an inner curved surface 27 and a through hole; the through hole has a curved surface 31 to be mounted over the threads 36 of the cylindrical body 35 in the punch assembly 18; the inner side of the curved surface 31 is furnished with a cylindrical surface 29 having a larger diameter; a shoulder portion 30 is formed between the cylindrical surface 29 and the curved surface 31 in the through hole. After the fastening ring 19 and the threaded ring 20 are assembled together, a space is formed between the shoulder portion 30 and the cylindrical surface 29; the inner curved surface 27 of the fastening ring 19 is furnished with threads 28 and a cylindrical surface 29; the cylindrical surface 29 is designed to fit for the diameter and height of the threaded ring 20; the threads 28 is designed to fit for the threads 17 of the threaded rod 15 of the body 12 in the pneumatic metal-work tool 11. The cylindrical body 35 of the punch assembly 18 is to be mounted in the threaded hole 16 of the threaded rod 15, and the mounting distance thereof has been pre-set with the threaded ring 20 before the fastening ring 19 being mounted on the outer threads 17 of the threaded rod 15 so as to have the punch assembly 18 and the threaded rod 15 connected together by means of a pressure furnished between the fastening ring 19 and the shoulder portion 30.

The outer curved surface 32 of the fastening ring 19 in the fastening device is furnished with vertical threads 33 on the outer curved surface 32 thereof, and the outer surface thereof is furnished with at least one rectangular hole 34, of which the width is about equal to the diameter of the stop screw 21 mounted in the threaded ring 20. The rectangular hole 34 in the fastening ring 19 is used for adjusting the related position between the screw hole 25 of the threaded ring 20 upon the fastening ring 19 being set in loose condition; a hexagonal wrench can engage, through the rectangular hole 34, with the hexagonal hole 26 of the stop screw 21 so as to have the stop screw 21 turned tight or loosely and to set the threaded ring 20 in fastened position.

To assemble the fastening device, the fastening ring 19 should first be mounted on the threads 36 of the cylindrical body 35 in the punch assembly 18; then, put a stop screw 21 into the screw hole 25 of the threaded ring 20; before the stop screw 21 passing through the threads, the threaded ring 20 can move freely to mount on the threads 36 of the cylindrical body 35 by means of threads 23 thereof. As soon as the threaded ring 20 is moved to the mid-position of the threads 36, the fastening ring 19 on the cylindrical body 35 should be moved towards the threaded ring 20 so as to have the inner curved surface 27 of the fastening ring 19 mounted over the outer curved surface 24 of the threaded ring 20; then, turn the stop screw 21 in he screw hole 25 of the threaded ring 20 until the stop screw being stopped by the inner curved surface 27 without being loosened unintentionally.

The fastening ring 19 and the threaded ring 20 are assembled into an assembly, and one end of the threads 36 with the screw hole 25 extend out of the fastening ring 19. After the punch assembly 18 and the threaded rod 15 of the body 12 are connected together, the threads of the cylindrical body 35 will be engaged with the inner threads 16 of the threaded rod 15 together; in that case, if the length between the two aforesaid parts is not set, the punch shaft 14 would be unable to punch a hole or edge a sheet of metal by means of the actuation force of the body 12, the punch shaft 38 and the punch assembly 40; in other words, the distance between the cylindrical body 35 of the punch assembly 18 and the threaded rod 15 on the front end of the body 12 must be adjusted properly; during such adjustment, the stop screw 21 in the screw hole 25 of the threaded ring 20 mounted to the threads 36 should be set in a loose condition without hindering the turning of the threaded ring 20; then, the fastening ring 19 on the threaded ring 20 is mounted over the outer threads 17 of the threaded rod 15 without turning tight, and then the rectangular hole 34 of the fastening ring 19 should be turned so as to have it aligned with the screw hole 25 in the outer curved surface 24 of the threaded ring 20 upon the fastening ring 19 and the threaded rod 15 being set in loose condition; then, use a hexagonal wrench to go through the rectangular hole 34 of the fastening ring 19 and to insert into the hexagonal hole 26 of the stop screw 21 so as to have the threaded ring 20 and the fastening ring 19 moved to a desired position, i.e., to set a proper distance between the cylindrical body 35 of the punch assembly 18 and the threaded rod 15 on the front of the body 12 of the pneumatic metal-work tool 11.

When the threaded ring 20 and the fastening ring 19 are moved together to a desired punch distance for the pneumatic metal-work tool 11, i.e., a given distance from the punch hole of the punch assembly 18, the stop screw 21 in the threaded ring 20 will be fixed in place, and the hexagonal wrench is removed so as to have the fastening ring 19 and the threaded rod 15 fastened together. If the operation value reaches the punch value, the stop screw 21 in the threaded ring 20 must be fastened in place with reinforced screwing force so as to have the fastening ring 19, the threaded ring 20 and the punch assembly 18 assembled together as one piece without disassembling the whole piece frequently. If the operation value is not reached the punch value, the fastening ring 19 must be loosened by unscrewing it so as to adjust the corresponding position between the rectangular hole 34 of the fastening ring 19 and the screw hole 25 of the threaded ring 20; unscrew the stop screw 21 to a loose position before adjusting the position of the threaded ring 20 until the threaded ring 20 being set at a given operation value as pre-designed; then, fasten the stop screw 21 tight so as to have the threaded ring 20 and the punch assembly 18 connected together firmly.

The punch value of the punch assembly 18 or the edge-folding assembly should be preset; whenever changing a punch assembly 18 having different diameter, the threads 36 of the cylindrical body 35 should be fastened into the threaded hole 16 of the threaded rod 15 on the front end of the body 12 until the end of the threaded ring 20 being limited and stopped, and then the punch assembly 18 is stopped to move; turn the fastening ring 19 over the threaded ring 20 along the outer threads 17 of the threaded rod 15 until the fastening ring 19 being unable to move, and then the punch assembly 18 and the body 12 are connected together. To replace an assembly, the fastening ring 19 should be loosened to separate from the threads 17 of the threaded rod 15; then, let the punch assembly 18 separate from the threaded hole 16 of the threaded rod 15, and then the disassembling steps are completed.

The threaded rod 15 on the front end of the body 12 of the pneumatic metal-work tool 11 is furnished with inner threads 16 to be mounted with the threads 36 of the punch assembly 18; the threaded ring 20 on the threads 36 of the punch assembly 18 is used for limiting the mounting distance thereof. After the threaded ring 20 and the threaded rod 15 are connected together, the fastening ring 19 on the threaded ring 20 is mounted over the outer threads 17 of the threaded rod 15 so as to have it fastened to the threaded rod 15 of the body 12 finally without further calibration and adjustment before doing a new punch operation.

In case of punching a hole with different diameter, all have to do is to mount new punch assembly 18 after removing the fastening ring 19 and the previous punch assembly 18; then, a new punch operation can be started.

According to the detailed description of the preferred embodiment of the present invention, the features and structure thereof have been disclosed completely; it is apparent that the present invention has provided an obvious improvement in the field, and such improvement is never anticipated and accomplished by any person in the field; therefore, the structure of the present invention is deemed unique.

What is claimed is:

1. A fastening device of a punch assembly for a pneumatic metal-work tool comprising:

a body of said pneumatic metal-work tool having an externally threaded rod on a front end thereof and a punch shaft located in a center of the threaded rod, an inner cylindrical surface and an outer cylindrical surface of said threaded rod are furnished with threads respectively;

an actuation assembly having an outer cylindrical surface furnished with threads and an inner cylindrical surface thereof furnished with a punch shaft;

a stop screw;

a threaded ring which is a ring-shaped member with a rectangular section, and an inner surface thereof is furnished with threads, an outer surface thereof being a smooth surface; threads of said inner surface to be engaged with threads on the outer cylindrical surface of the actuation assembly; said threaded ring furnished with a through screw hole for receiving the stop screw;

a fastening ring mounted around said threaded ring, and having a first curved surface furnished with threads, a cylindrical surface and a second curved surface on an interior thereof, the second curved surface having a diameter that is smaller than a diameter of the cylindrical surface; a shoulder portion formed between said second curved surface and said cylindrical surface, and said shoulder portion being in close contact with an outer surface of said threaded ring; and at least one rectangular through hole.

2. A fastening device of a punch assembly for a pneumatic tool as claimed in claim 1, wherein said actuation assembly is a punch assembly for punching a hole.

3. A fastening device of a punch assembly for a pneumatic tool as claimed in claim 1, wherein said actuation assembly is an edge-folding assembly for folding an edge.

* * * * *